US005524894A

United States Patent [19]

Shannon

[11] Patent Number: 5,524,894

[45] Date of Patent: Jun. 11, 1996

[54] HEAD MOVEMENT SENSOR FOR GOLF PRACTICE

[76] Inventor: Allan P. Shannon, 3821 Bee Tree La., Fort Worth, Tex. 76133

[21] Appl. No.: 344,081

[22] Filed: Nov. 23, 1994

[51] Int. Cl.[6] ..... A63B 69/36

[52] U.S. Cl. ..... 473/209; 33/366; 473/211

[58] Field of Search ..... 273/35 R, 187.2, 273/190 R, 190 A; 33/366

[56] References Cited

U.S. PATENT DOCUMENTS

| | | | |
|---|---|---|---|
| 2,023,748 | 12/1935 | Shipley | 340/689 X |
| 2,754,497 | 7/1956 | Wolpert | 340/279 |
| 3,156,211 | 11/1964 | Mallory | 273/190 A X |
| 3,648,686 | 3/1972 | Payne | 128/2.1 R |
| 4,392,830 | 7/1983 | Salzman et al. | 273/187.2 X |
| 4,502,035 | 2/1985 | Obenaauf et al. | 273/190 A X |
| 4,527,982 | 7/1985 | Salzman et al. | 273/190 A X |
| 4,531,300 | 7/1985 | Heidel et al. | 33/366 |
| 4,547,972 | 10/1985 | Heidel et al. | 33/366 |
| 4,869,509 | 9/1989 | Lee | 273/187.2 |
| 4,912,662 | 3/1990 | Butler et al. | 364/559 |
| 4,993,710 | 2/1991 | Marshall | 273/32 H |
| 5,005,835 | 4/1991 | Huffman | 273/187.2 |
| 5,083,383 | 1/1992 | Heger | 33/366 |
| 5,087,047 | 2/1992 | McConnell | 273/183 B |
| 5,199,712 | 4/1993 | Hoyle, Jr. et al. | 273/187.2 |
| 5,251,902 | 10/1993 | Federowicz et al. | 273/187.2 |

FOREIGN PATENT DOCUMENTS 2168149 6/1986 United Kingdom .

OTHER PUBLICATIONS

Shannon, Head Movement Sensor For Golf Practice, U.S. Ser. No. 08/091,349, Filed Jul. 14, 1993, Abandoned.

*Primary Examiner*—William H. Grieb

*Attorney, Agent, or Firm*—James E. Bradley; Grady K. Bergen

[57] ABSTRACT

A head movement sensor, which may be used for such things as golf practice, is adapted to be attached or carried on a person's head. The device consists of a sensor which is mounted to the head and senses an initial position by means of a hollow tube carrying a conductive liquid with electrodes extending within the tube. The tube is shaped so that as the head is angularly displaced from the initial position to a displaced position, the liquid flows within the tube, changing the resistance between the electrodes. By measuring the change in resistance, an electrical signal can be derived. Sudden changes in angular displacement also produce an electrical signal. The electrical signals are processed to produce an audible indication.

20 Claims, 6 Drawing Sheets

HEAD MOVEMENT SENSOR FOR GOLF PRACTICE

BACKGROUND OF THE INVENTION

1. Field of the Invention

This invention relates to a device that is adapted to be carried on a person's head for monitoring the position or motion of the head.

2. Description of the Prior Art

In a variety of physical activities it is important that certain parts of the body remain motionless as others are being moved. This is evident in such activities as golf where a club is swung about an axis which extends through the upper body and head. Most inexperienced golfers have a tendency to move their heads during their golf swings. Such movement of the head, however, can change the position of the axis about which the club is being swung, resulting in a poor golf swing and a bad game of golf. Because this is such a natural tendency for most beginning golfers, it is difficult for the inexperienced player to perceive any such movement.

There are a variety of methods that have been developed to monitor head motion in such activities. Most of these devices, however, rely on after-the-fact indication or are too involved or complicated enough to prevent the ordinary person from employing the device.

It would be desirable to have a head motion detector or sensor for indicating the position and/or motion of a person's head, in such activities as golf, that provides instantaneous feedback, is simply constructed and simple to operate.

SUMMARY OF THE INVENTION

This invention provides a device which can be easily used and gives an instantaneous feedback of the position or motion of a person's head relative to an initial position. The device is adapted to be carried on the person's head and consists of a sensor or transducer containing a conductive liquid which senses the initial position. The sensor produces a change in an electrical signal in response to an angular displacement of the head between an initial position and a displaced or inclined position or the rate of angular displacement reaching a preselected amount.

Connected to the sensor is a signal responsive means which provides an audible indication to the user when the head is other than in the beginning or initial position or when the rate of angular displacement reaches the preselected amount.

A signal adjuster can be added to the device to adjust the electrical signal so that there is no indication given when the head is in the initial position. A signal interrupter can also be added for cutting off the electrical signal when head movement is exaggerated, such as when the user bends down to pick up a ball.

DETAILED DESCRIPTION OF THE INVENTION

Figure 1:
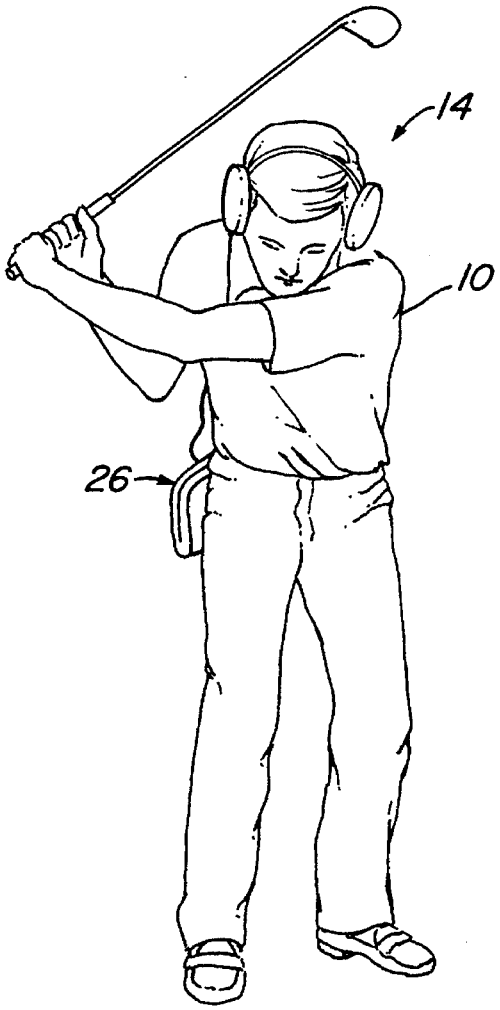
FIG. 1 is an illustration of a golfer using the device constructed in accordance with the invention.

FIG. 1 shows a golf player 10 wearing a head motion detector 14 constructed in accordance with the invention.

Figure 2:
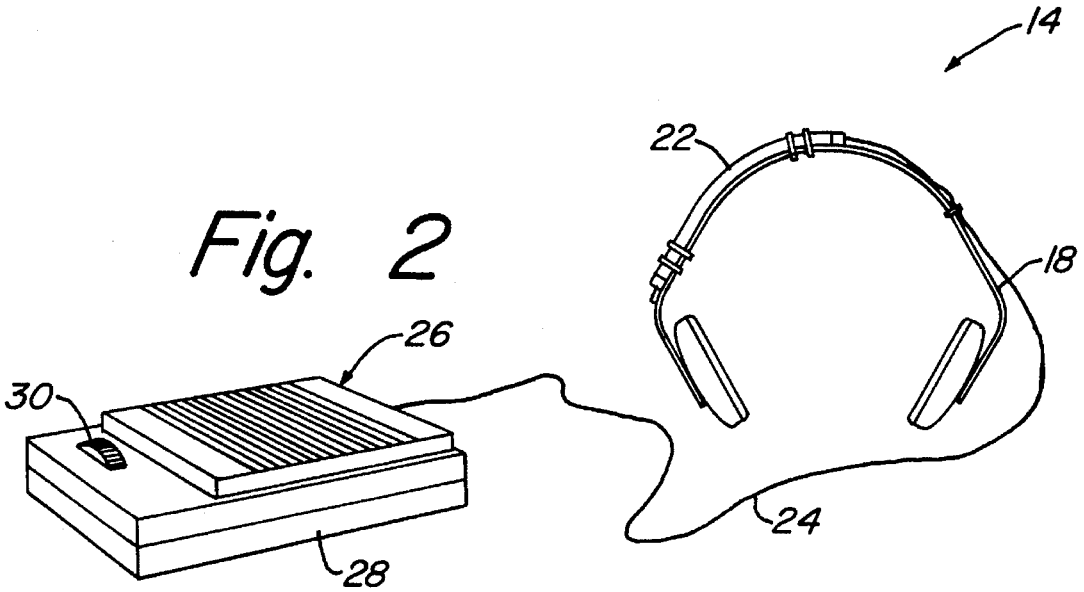
FIG. 2 is a perspective view of the device constructed in accordance with the invention.

The head motion detector 14, as shown in FIG. 2, consists of a headset or band 18 which can be positioned on the head. Connected to the headset 18 is a sensor or transducer 22 which is attached by electrical wiring 24 to a controller 26 housed within a box or housing 28 which houses the electrical components of the controller 26. The box or housing 28 has a dial 30 which is used to switch the detector 14 on or off and also as a means for zeroing the detector 14.

Figure 3:
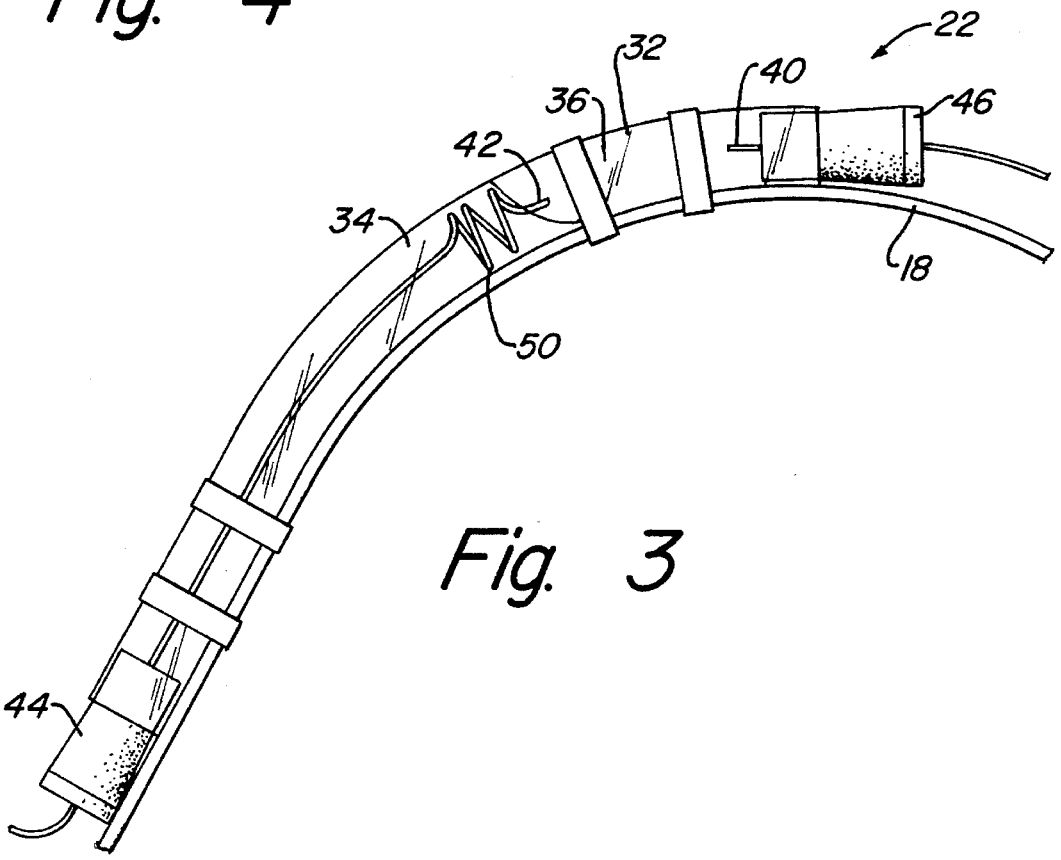
FIG. 3 is a schematic circuit of the device of FIG. 2, showing the elements of the circuitry used in the device.

Referring to FIG. 3, a curved, fluid impermeable tube 32 is filled with a conductive liquid or solution 34. An air bubble 36 is also located within the tube 32. The bubble 36 tends to move to the highest point within the liquid filled tube 32. The conductivity of the liquid should be in the range of 20 to 200 kilohms per inch and preferably 130 to 190 kilohms per inch. The solution 34 can be made from an alcohol/ionized water solution and should be of a viscosity that allows the liquid 34 to flow easily through the tube 32.

Electrodes 40, 42 extend inside the tube 32 through rubber stoppers 44, 46 located in each end of the tube 32. In the embodiment shown, the wire used is American Wire Gage 20, Type 5, which has a varnished cambric coating. The coating extends along the length of the electrode 40, 42, including portions located within the tube 32. The stoppers 44, 46 are provided to seal each end of the tube 32.

As shown in FIG. 3, electrode 42 extends through most of the interior of the tube 32. The end of electrode 42 is bent or twisted so that a portion 50 of the wire 42 is in contact with the interior walls of the tube 32. This stabilizes the free end of electrode 42 within the tube 32. The electrode 42 terminates a distance from electrode 40 which is less than the length of the bubble 36.

As can be seen in FIG. 3, the tube 32 is curved so that as the head piece 18 is rotated, the bubble 36 begins to move through the tube 32.

Figure 4:
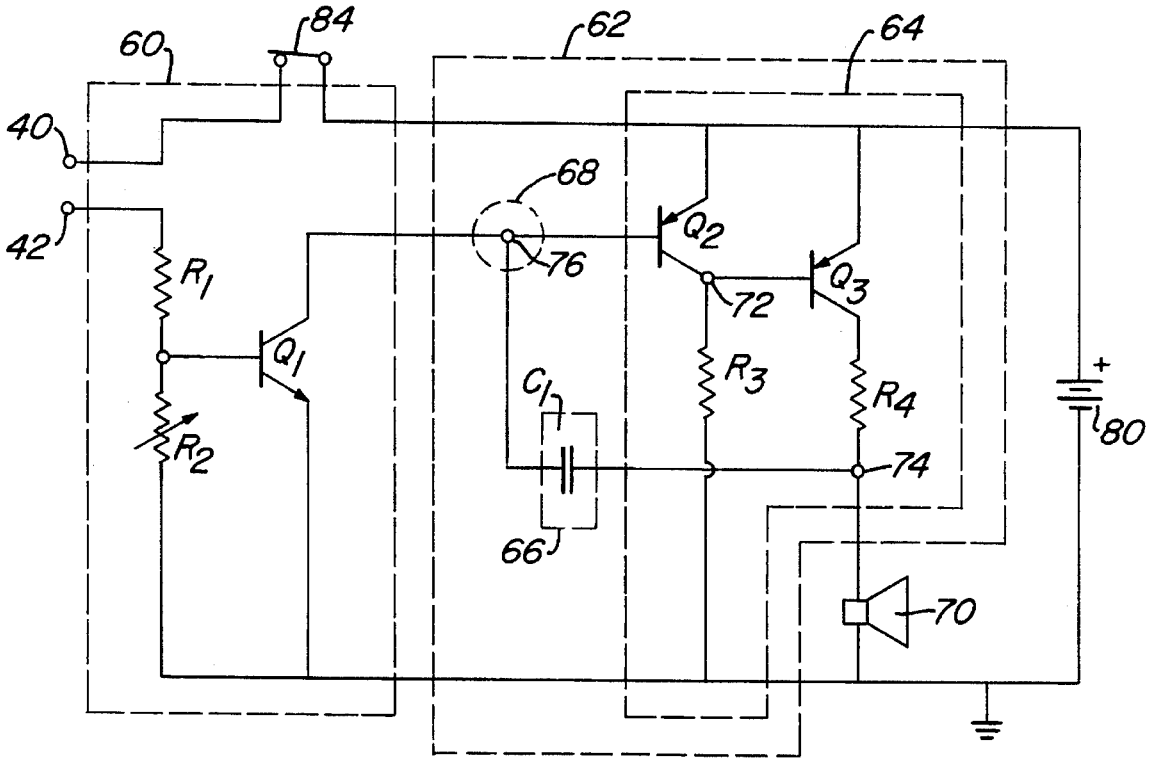
FIG. 4 is an enlarged side view of the tube and electrodes employed in the device of FIG. 2.

FIG. 4 shows a schematic of the circuitry of the device 14. While the embodiment of FIG. 4 measures changes in resistance and employs the use of variable resistors, it should also be noted that the same result could be achieved by measuring inductance, capacitance, Hall effect and changes in electromagnetic field strength. An appropriate device for giving audible feedback can be constructed in the manner described for the circuitry in the apparatus described in U.S. Pat. No. 3,648,686.

The electrodes 40 and 42 provide the operating point for an amplifier 60 which yields a DC signal representative of the variable resistance sampled by the electrodes 40 and 42. The DC signal provides the input signal for a feedback oscillator 62. Feedback oscillator 62 includes a base amplifier 64, a feedback network 66 and a mixing network 68. The feedback oscillator 62 yields an audio signal, the frequency of which is representative of the resistance sampled between electrodes 40 and 42. The oscillating signal is converted into an audible signal by speaker 70 that varies in pitch corresponding to the degree of angular displacement of the head from an initial position to a displaced or inclined position.

The electrodes 40, 42 are shown in series combination with a resistor $R_1$. This series combination in conjunction with a variable resistor $R_2$ sets the operating point for transistor $Q_1$ of the amplifier 60. Transistor $Q_1$ is illustrated in the grounded emitter configuration. The amplified DC current or signal at the collector of transistor $Q_1$ provides the input signal for feedback oscillator 62. Feedback oscillator 62 includes transistor $Q_2$ and $Q_3$ in cascade. Oscillator 62 is an audio oscillator of the type whose frequency can be varied within the audio range. The frequency of oscillator 62 is controlled by the transistor $Q_1$. As shown in this embodiment, transistor $Q_1$ is shown as an NPN transistor and transistors $Q_2$ and $Q_3$ are shown as PNP types. In the cascaded form, the collector of transistor $Q_2$ is coupled to the base of transistor $Q_3$ by terminal 72. Resistor $R_3$ couples terminal 72 with ground potential. Resistor $R_4$ couples the collector of transistor $Q_3$ with output terminal 74. Capacitor $C_1$ intercouples terminal 74 with the base of transistor $Q_2$ at terminal 76 and provides a portion of the feedback network for feedback oscillator 62. The oscillating output signal of feedback oscillator 62 at output terminal 74 is coupled to speaker 70 which converts the electrical signal to an audible signal susceptible to perception by a human. A battery 80 provides the bias signal for transistors $Q_1$, $Q_2$ and $Q_3$.

Specifically, a description of the components used in the circuitry of the device 14 are given below. The amplifier transistor $Q_1$ as used in the present embodiment is a 2N5089 NPN transistor. The resistor $R_1$, coupled to the base of the transistor $Q_1$ and the electrodes 40, 42, is a ten kilohm resistor. The variable resistor $R_2$ is a 100 kilohm variable resistor which connects the base of the transistor $Q_1$ with ground potential. The two transistors $Q_2$, $Q_3$ in cascaded form are 2N9614 PNP transistors. The collector to base inner connection of the cascaded transistors $Q_2$, $Q_3$ are connected to ground by resistor $R_3$, which is a 470 ohm resistor. Resistor $R_4$ is a 15 ohm resistor coupled to the output terminal 74 of the feedback amplifier 64 to the collector of the output transistor $Q_3$. In the feedback oscillator 62, a 0.33-microfarad capacitor $C_1$ is coupled to the output terminal 76. The speaker 70 is an eight-ohm speaker and the battery 80 is a three-volt battery used to supply a bias signal for the circuit.

The speaker 70 may be located with the housing 28 or provided in the form of earphones with the headset 18. An ear piece (not shown) may also be provided which can be inserted into the user's ear to provide the audible signal without disturbing others. The circuitry of the device 14 may also be self-contained within the headset 18 so that no separate housing 28 is needed.

A limit switch 84 may also be incorporated into the circuit, as shown in FIG. 4, so that when the head is tilted to a preselected inclined position, the circuit will open so that the amplifier 60 provides no signal, and no audible indication is given by the speaker 70. Such a switch 84 may be any type of limit switch, such as a mercury switch, which causes the circuit to open when the head is moved beyond the preselected displaced position. This allows the user to bend or turn his head to an exaggerated degree without the detector 14 creating the audible indication and prevents the indication from becoming a nuisance, such as when the user bends over to pick up a ball.

Operation of the detector 14 occurs in the following manner. The headset 18 is attached to the head, as shown in FIG. 1. The housing 28 is attached to the users belt or appropriately positioned somewhere where the housing 28 will not interfere with the user's movement. The user switches the detector 14 on by adjusting dial 30. The dial 30 also adjusts the variable resistor $R_2$ after the detector 14 is turned on. When the bubble 36 is at the uppermost end of the tube 32, the bubble 36 effectively separates the electrodes 40, 42 so that no electrical current can flow between the electrodes 40, 42.

Figure 5:
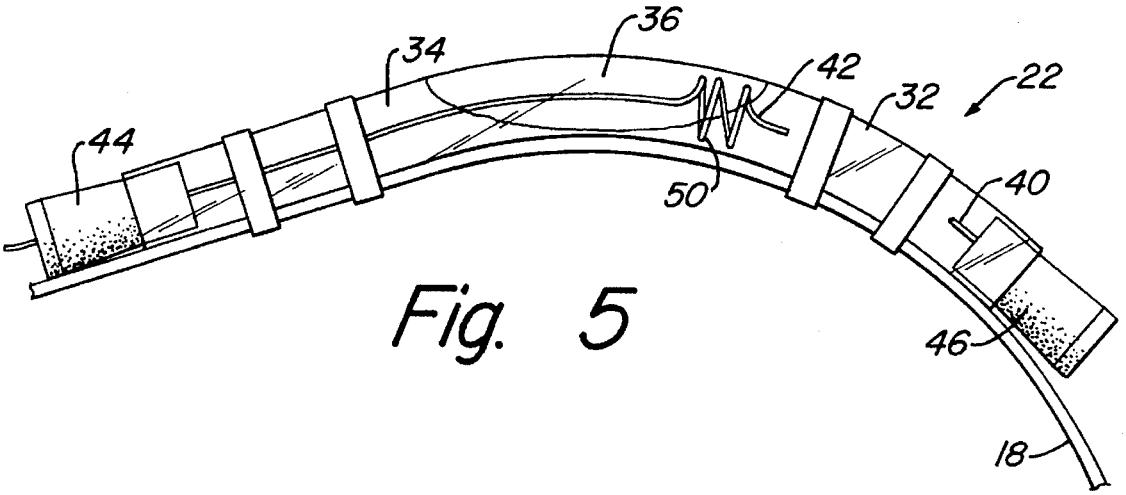
FIG. 5 is a side view of the tube and electrodes of FIG. 4 in an intermediate, angularly displaced position.
Figure 6:
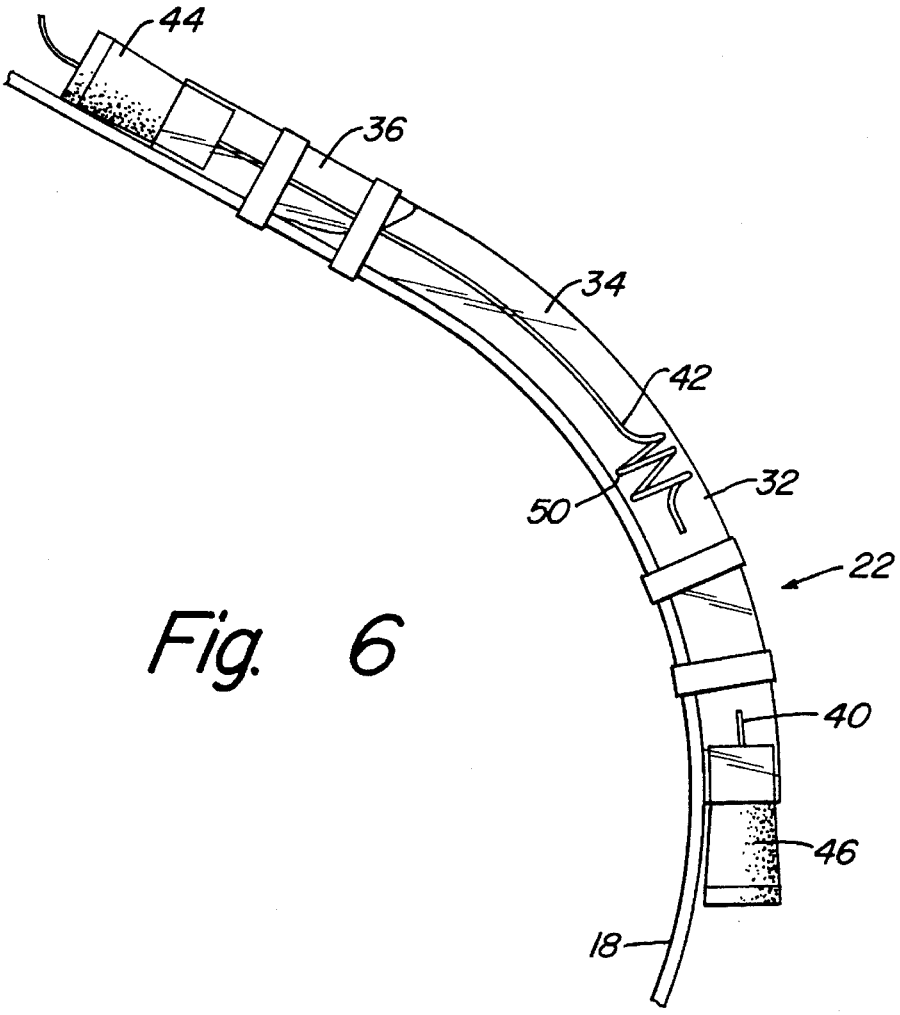
FIG. 6 is a side view of the tube and electrodes of FIG. 4 shown in an extreme, angularly displaced position.

The detector 14 indicates the change in position of the user's head by monitoring the change in resistance between the two electrodes 40, 42. The resistance between the electrodes 40, 42 changes as the bubble 36 moves through the tube 32. Referring to FIG. 3, the bubble 36 is located at the upper end of the tube 32 towards the stopper 46, separating the electrodes 40, 42 with the liquid 34 contacting only electrode 42 so that no current can pass from electrode 42 to electrode 40. Preferably, when the headset 18 is attached to the head, and the head is in the initial position, the bubble 36 will be at the uppermost end, as shown in FIG. 3. As the head is angularly displaced, the liquid 34 and bubble 36 will move through the tube 32 as shown in FIGS. 5 and 6. This is caused by the curved shape of the tube 32 and the tendency of the bubble 36 to move to the highest point within the tube 32.

FIG. 5 illustrates the bubble 36 shown substantially in the center of the tube 32 with the liquid 34 filling the gap between electrodes 40, 42 so that current can pass through the electrodes 40, 42. As more surface area of the electrode 42 is contacted by the liquid 34, the resistance between the electrodes 40, 42 decreases.

In FIG. 6, the bubble 36 is located at the end of the tube 32 near the stopper 44. Because the amount of surface area of the electrode 42 that is contacted by the liquid 34 increases as the tube 32 is rotated between the position shown in FIGS. 5 to the position shown in FIG. 6, the resistance decreases between the electrodes 40, 42. There is also a decrease in the resistance due to the shorter distance the current must pass through the liquid 34 as the bubble 36 moves toward the end of the tube 32 near stopper 44.

As the resistance between the electrodes 40, 42 changes and current is provided to the amplifier 60, the audio signal produced by the speaker 70 changes in both intensity and frequency as the resistivity changes. This indicates to the user when and to what extent the head is angularly displaced from the initial position.

When attached to the head, the tube 32 may be positioned as shown in FIG. 5 when the head is in the initial position. If so, a false indication may be given by speaker 70 which indicates that the user's head is in an inclined position. By adjusting the variable resistor $R_2$ by means of the dial 30, the audible signal of speaker 70 may be controlled so that no indication is given. As the variable resistor $R_2$ is adjusted, a new operating point of transistor $Q_1$ is set, controlling the initial input signal on the feedback oscillator 62.

Figure 7:
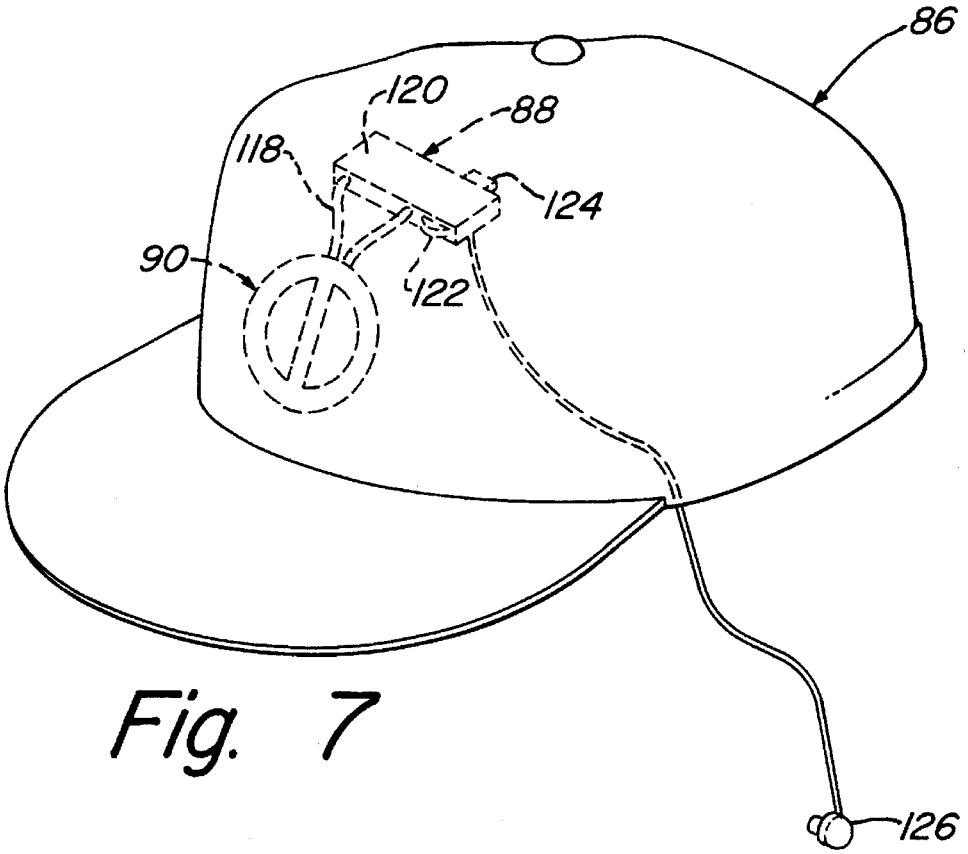
FIG. 7 is a perspective view of a hat using another embodiment of the device constructed in accordance with the invention.
Figure 8:
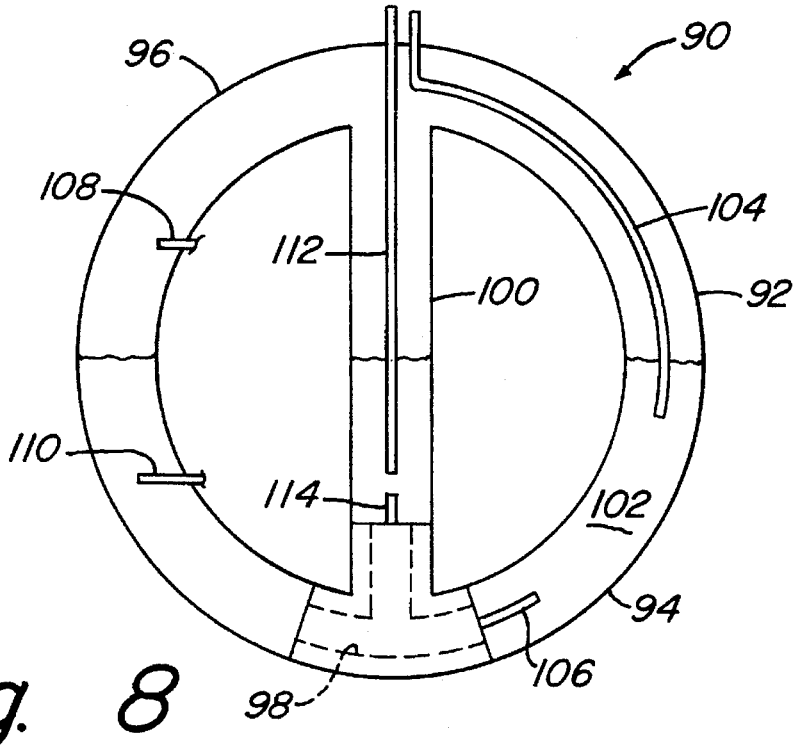
FIG. 8 is a front elevational of a sensor used in the device of FIG. 7 constructed in accordance with the invention.

FIGS. 7–10 show another embodiment of the invention. Referring to FIG. 7, a hat 86 is shown with a motion detector 88. The detector 88 comprises a small sensor 90 formed from a continuous length of tubing 92 which is configured in a substantially circular shape and positioned at the approximate center of the hat 86 in a transverse position. It should be noted, however, that the sensor 90 may be positioned in a variety of orientations to provide monitoring of different types of motion. The tubing 92 is formed from a nonconductive, fluid impervious material, such as glass or plastic. FIG. 8 shows the sensor 90 oriented in an initial resting position. For convenience of description, all components are described with reference to the sensor 90 as shown in this initial position.

The circular tubing 92 is divided into a lower half 94 and an upper half 96. Formed in the lowermost point of the lower portion 94 of the sensor 90 is a fluid constriction 98 which extends for a distance along the lower portion 94. The fluid constriction 98 can be a venturi or an area of decreased inner diameter of the tubing 92, with the remainder of the tubing 92 having a substantially uniform inner diameter and cross-sectional area. Extending between the lower and upper halves 94, 96 of the tube 92 is a crosstube 100. The crosstube 100 is also formed from a nonconductive, fluid impervious material. The upper end of the crosstube 100 is in fluid communication with the upper portion 96 of the circular tubing 92 and the lower end of the crosstube 100 is in fluid communication with the fluid constriction 98 of the lower portion 94. The crosstube 100 should have an inner diameter that is less than that of the tubing 92. The crosstube 100 passes through the very center point of the sensor 90.

The sensor 90 is filled with a conductive liquid 102, such as an isopropyl alcohol and water solution. The liquid 102 should have a fairly high resistance, preferably between 20 to 200 kilohms per inch, and more preferably 130 to 190 kilohms per inch of solution. The liquid 102 should be of a low enough viscosity to allow the liquid 102 to flow freely through the tubing 92 and 100. The remainder of the sensor should be filled with air or another nonconductive fluid having a specific gravity lower than that of the liquid 102. The level of solution 102 should fill the lower half of the tube 92 and the crosstube 100 when the sensor 90 is oriented in the initial resting position so that the level of the liquid 102 substantially bisects the sensor 90, passing through the center point within the crosstube 100.

Depending upon the mode of operation of the detection unit 88, different electrodes 104–114 are used to provide various signals which will each be discussed in turn. Located within the circular tubing 92 are upper and lower electrodes 104, 106 for detecting a degree of angular displacement. The upper electrode 104 is curved downward from approximately the center of the upper portion 96 and terminates in a free end located above the liquid 102 or which dips slightly into the liquid 102. The lower electrode 106 is spaced apart from the upper electrode 104 and is located at or near the lowermost end of the lower portion 94 of the tube 92. Although only a single pair of electrodes 104, 106 are shown, it is within the scope of this invention to provide more than one upper electrode 104 or pair of electrodes 104, 106 for different sides of the circular tube 92 to detect angular displacement in different directions.

Also located within the circular tubing 92 are contact electrodes 108, 110. These electrodes provide an on/off signal when a certain degree of angular displacement is achieved. The electrodes 108, 110 are spaced apart a selected distance which may vary by moving the upper electrode 108 up or down depending upon the degree of angular displacement desired to be measured. As can be seen, the electrode 108 is located above the solution level while the electrode 110 is located in contact with the solution 102 when the sensor 90 is in the initial position. Although only one pair of electrodes 108, 110 is shown, it is within the scope of this invention to provide more than one upper electrode 108 or pair of electrodes 108, 110 for different sides of the circular tube 92 to detect clockwise or counterclockwise rotation.

The crosstube 100 is also provided with a pair of electrodes 112, 114 which provide a signal during quick or accelerated angular displacement. The electrode 112 is an upper electrode which extends downward from the upper end of the tube 100, through the approximate center point of the sensor 90 and terminates a slight distance from the end of the electrode 114. The electrode 114 is a lower electrode and is located at the lower end of the crosstube 100 in contact with the solution 102.

The electrodes 104–114 are made of an electrically conductive material. The electrodes 104 and 112 should have a fairly high resistivity, such as the nickel/chromium wire marketed as "Tophet C" available from W B Driver Alloys. Wire having a resistance of 55 Ohms/ft and a diameter of 0.0035 inch was found to be suitable for these electrodes. It should be noted that the lower electrodes 106, 110 and 114 could all be combined into a single electrode located within the lower portion 94 of the tubing 92. It is also within the scope of this invention that the fluid constriction 98 could be formed of a conductive material and serve as a single electrode in place of the electrodes 106, 110 and 114.

Although not shown in FIG. 8, each electrode 104–114 is connected by wiring 118 (FIG. 7) to suitable circuitry of controller 120 which is attached to the hat 86 or otherwise carried by the user. The circuitry used in the controller 120 is the same as that shown in FIG. 4 and operates in the same manner as previously described for measuring changes in resistance. A dial 122 similar to the dial 30 of the embodiment of FIGS. 1–6 is provided for adjusting the signals from the sensor 90. A switch 124 is also provided for selecting between desired signals from the electrodes 104–114. An earpiece 126 allows the user to hear an audible indication from the detection unit 88 without disturbing others nearby.

The operation of the detection unit 88 is as follows. Because there are three possible modes of operation, each will be discussed separately. To measure a degree of change in angular displacement, the switch 124 is used to power the electrodes 104, 106. The electrodes 104, 106 operate in a similar manner to the electrodes 40, 42 of the embodiment of FIGS. 1–6. The circuitry of controller 120 also operates in the same manner. When the sensor 90 is in the initial position, the conductive liquid 102 contacts only a portion of the electrode 104. Some current may pass between the two electrodes 104, 106 to the controller 120 if the electrode 104 is initially in contact with the solution 102. This will likely cause a false indication to be given. The user can adjust the controller 120 by means of the dial 30 so that it is zeroed and no indication is given when in this initial position.

Figure 9:
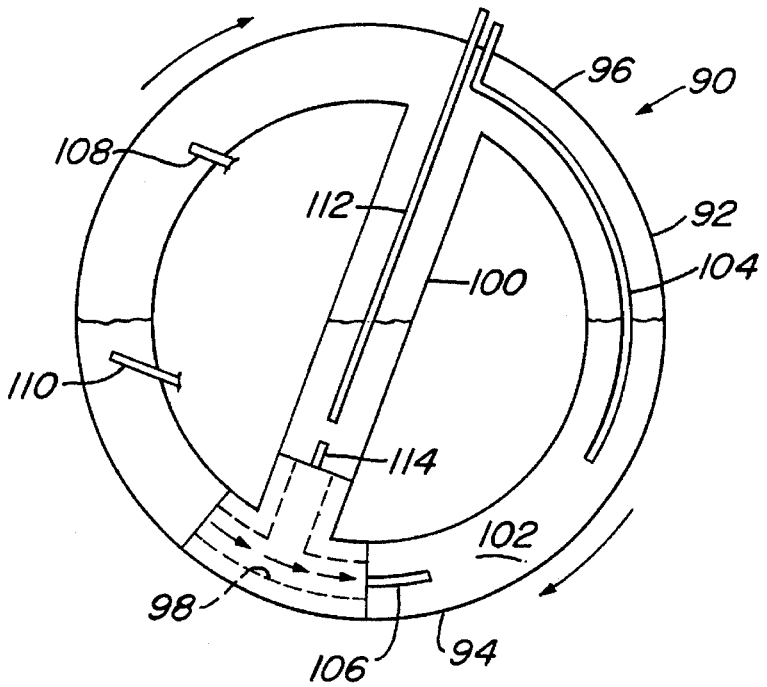
FIG. 9 is front elevational view of the sensor of FIG. 8 showing the sensor being rotated so that fluid flows through a fluid constriction of the sensor in a slow, even manner.

During a golf swing, any tilting of the user's head will cause the sensor 90 to rotate. As a result, the solution will flow through the tubing 92, as shown in FIG. 9, contacting more or less of the electrode 104 and thereby changing the resistance between the two electrodes 104, 106. As the resistance between the electrodes 104, 106 changes, the audio signal produced by the controller 120, which measures these perturbations in resistance, changes in both intensity and frequency through the earpiece 126. This indicates to the user when and to what extent the user's head is angularly displaced from the initial position. Although it is not necessary, the electrode 104 can be provided on either side of the circular tube 92 so that the degree of angular displacement can be measured more easily for either clockwise or counterclockwise rotation, as viewed in FIG. 9.

Figure 10:
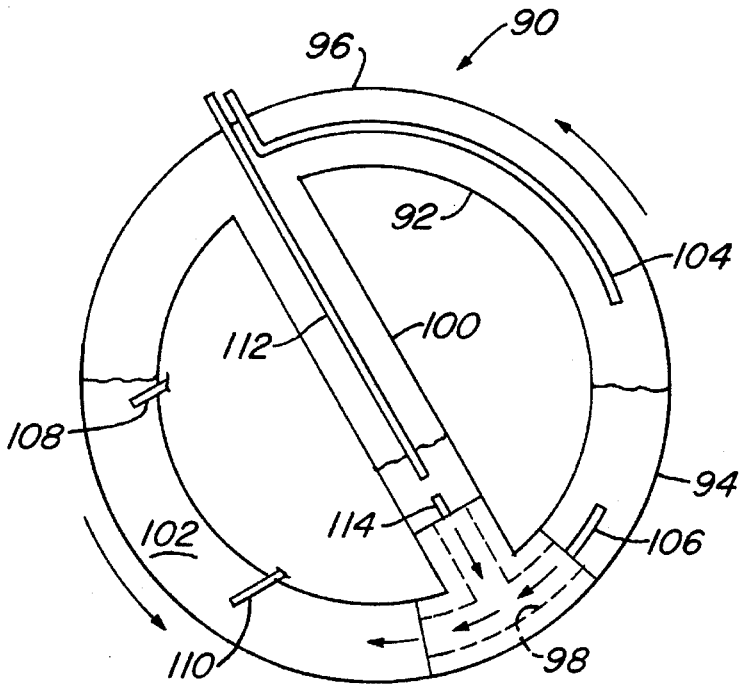
FIG. 10 is a front elevational view of the sensor of FIG. 8 showing the sensor being rotated quickly to cause a pressure drop through the fluid constriction.

To measure a predetermined degree of tilt, the detection unit 88 is switched by means of switch 124 so that the electrodes 108, 110 are powered. When the sensor 90 is in the initial position (FIG. 8) the upper electrode 108 is held out of contact with the solution 102. When the sensor 90 is rotated to a predetermined degree, as shown in FIG. 10, the electrode 108 comes into contact with the conducting liquid 102 so that current passes between the electrodes 108, 110 and the controller 120 produces an audible indication. Although the controller 120 is designed for measuring changes in resistivity, the controller 120 will function in a similar manner when current initially passes between the electrodes 108, 110. By spacing the electrodes 108, 110 further apart or closer together, the amount of tilt necessary to produce the audio signal is established. Thus, for example, the electrodes 108, 110 could be spaced apart so that the solution 102 contacts both electrodes 108, 110 after 20 degrees of rotation. It should be noted as well that the electrodes 108, 110 could also be placed on either side of the circular tube 92 to indicate rotation in either the clockwise or counterclockwise direction.

If the user wishes to determine quick or sudden movements due to greatly accelerated angular displacement, the user switches the control unit 120 so that power is supplied to the electrodes 112, 114. As seen in FIG. 8, when the sensor 90 is in the initial position, the conductive liquid 102 contacts both the upper and lower electrodes 112, 114, with a large portion of the upper electrode 112 being contacted by the solution 102. When the sensor 90 is rotated in either a clockwise or counterclockwise direction, the conductive liquid 102 flows through the fluid constriction 98 at the bottom of the circular tube 92, as shown by the smaller arrows of FIGS. 9 and 10. If the rotation of the sensor 90 is slow and even, the flow of fluid through the constriction 98 will not create any significant pressure drop through the constriction 98 and the fluid level within the crosstube 100 will not drop. Thus, the portion of the upper electrode 112 which contacts the solution 102 does not change so that there is no change is resistivity between the electrodes 112, 114.

If, however, the rotation of the sensor 90 is rapid or greatly accelerated, such as caused by the sudden jerking of a golfer's head during a golf swing, the flow of liquid 102 through the constriction 98 will cause a significant pressure drop through and across the constriction 98. This causes the fluid level within crosstube 100 to drop, as shown in FIG. 10, so that there is less solution 102 in contact with the upper electrode 112. The resistivity or current flowing between the electrodes 112, 114 is thus changed causing the controller 120 to produce an indication in response to the accelerated movement of the sensor 90.

Figure 11:
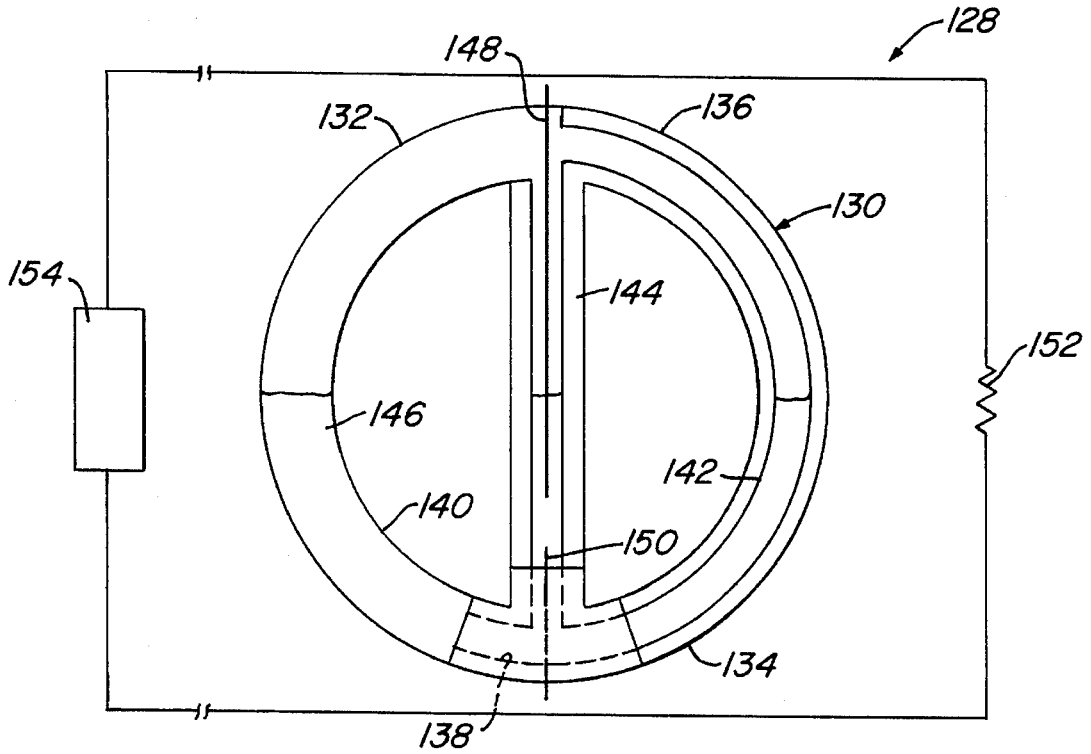
FIG. 11 is front of elevational view of another embodiment of the device constructed in accordance with the invention.
Figure 12:
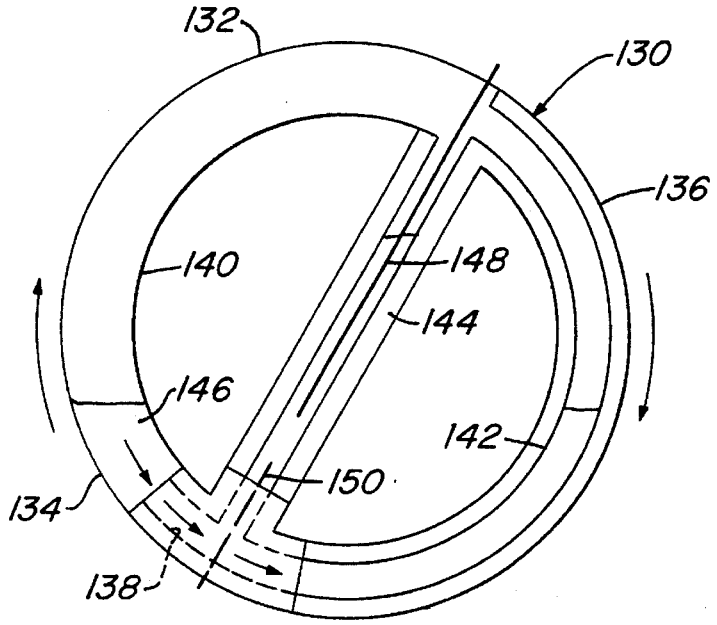
FIG. 12 is a front elevational view of a sensor of the device of FIG. 11 showing the sensor being rotated.

FIGS. 11 and 12 show still another embodiment of the invention. FIG. 11 shows a detection device 128. The detection device 128 is similar to that of FIGS. 7–10 and is comprised of a sensor 130 which may also be positioned in a hat, such as the hat 86 of FIG. 7, or other head gear, so that it is carried on a person's head.

The sensor 130 is formed from a continuous length of tubing 132 which is configured into a substantially circular shape. The tubing 132 is divided into a lower half 134 and an upper half 136. A fluid constriction 138 is formed in the lower portion 134 of the tubing 132, which is similar to the fluid constriction 98 of the sensor 90. The fluid constriction 138 divides the tubing 132 into left and right arms 140, 142, as viewed in FIG. 11. The left arm 140 has a larger inner diameter than the right arm 142. For example, the left arm 140 may have an inner diameter of ¼ inch, with the right arm 142 having a inner diameter of ⅛ inch. This gives the left arm 140 a greater cross-sectional area and greater unit volume than the right arm 142. In the embodiment of FIGS. 11 and 12, the fluid constriction 138 is of a constant diameter equal to the inner diameter of the right arm 142.

Extending between the lower and upper halves 134, 136 of the tubing 132 is a crosstube 144. The upper end of the crosstube 144 is in fluid communication with the upper portion 136 of the tubing 132 and the lower end of the crosstube 144 is in fluid communication with the fluid constriction 138. The center point of the sensor 90 locates within the crosstube 144. The inner diameter of the crosstube 144 may vary, but it should be less than that of the left arm 140. In the embodiment shown, the inner diameter of the crosstube is equal to the inner diameter of the right arm 142.

A conductive liquid 146, similar to the conductive liquid 102, fills the lower half 134 of the tubing 132 and the crosstube 144 when the sensor 130 is oriented in an initial resting position, as shown in FIG. 11. Positioned within the crosstube 144 are a pair of electrodes 148, 150 which are spaced apart and in contact with the liquid 102. The electrodes 148, 150 are also made of a high resistance wire such as the "Tophet C" previously discussed. The electrode 148 is an upper electrode which extends downward from the upper end of the crosstube 144, and through the approximate center point of the sensor 130. The electrode 150 is located at the lower end of the crosstube 144 and is spaced apart a slight distance from the upper electrode 148.

Wired in parallel with the electrodes 148, 150 is a resistor 152. The resistor 152 can be of constant resistance, such as a one megohm resistor, or can be a variable type resistor which can be adjusted by the user. The resistor 152 stabilizes the signal from the sensor 130. A controller 152, similar to that used for the embodiments of FIGS. 1–10, receives the signal from the sensor 130.

In operation, the sensor 130 is mounted into position on the user's head. The controller 154 is turned on so that electrical current is supplied to the electrodes 148, 150. If desired, the controller 152 is adjusted so that no indication is given when the sensor 130 is in the initial resting position.

When the sensor 130 is rapidly rotated or angularly displaced, due to the sudden movement of the user's head, the fluid 146 will flow through the tubing 132. FIG. 12 shows the sensor 130 when it is rotated in a clockwise direction. As this occurs, fluid from the left arm 140 flows through the constriction 138 into both the right arm 142 and the crosstube 144. This is due to the lower unit volume of the right arm 142 and crosstube 144, and the momentum of the fluid 146 caused by the rotation of the sensor 130. Thus, the increased level of fluid 146 within the tube 144 causes more of the electrode 148 to be contacted, decreasing the resistance between the electrodes 148, 150 and causing the controller 154 to produce an audible indication in response to the sudden change in resistance.

If the sensor 130 is rotated in the counter-clockwise direction, the fluid level within the crosstube 144 and right arm 142 drops more suddenly due to the increased volume of the left arm 140. This causes less of the electrode 148 to be contacted with the solution 146 and increases the resistance between the two electrodes 148, 150. In response to this change, the controller 154 produces an indication.

It should be noted that the signal produced and the responsiveness of the sensor of the invention are controlled by a number of different factors. These factors include the fluid levels within the various portions of the sensor and the electrical resistance of the electrodes and the conducting liquid. The fluid levels are affected by the volume of the individual arms of the tubing and the crosstube and the pressure drop through the tubing and fluid constriction. By changing any of these variables, the sensor can be adjusted so that has a greater or lessor sensitivity.

The head motion detectors of the invention have several advantages over prior art head motion detectors. The detectors are simple to use and require no complex or involved equipment that must be assembled in order to use. By merely attaching the devices to one's head, one can monitor instantaneously the movement of the head from the initial reference position. The detector can be constructed so that the circuitry is self-contained with the headset or controller, and the audible indication can be provided with earphones or an earpiece so that there is no distraction to others in the area. The detection unit can detect a single predetermined angular displacement, changes in degree in angular displacement as well as quickly accelerated angular displacement caused by sudden jerking and rotating of the head.

While the invention has been shown in only some of its forms, it should be apparent to those skilled in the art that it is not so limited, but is susceptible to various changes without departing from the scope of the invention. For example, a different tube could be incorporated with the device to monitor angular displacement of the head in different directions or the device could measure changes in inductance or capacitance instead of resistance.

I claim:

1. A device for monitoring relative position of a person's head, the device adapted to be carried on a person's head, the device comprising in combination:

a sensor which includes:

a hollow, fluid impermeable conduit which contains a conductive liquid, the conduit being shaped so that the liquid flows through the conduit as the conduit is angularly displaced between an initial position and a displaced position; and a pair of electrodes which extend into the conduit and are spaced apart, the liquid contacting the electrodes as the liquid flows within the conduit so that electrical current passes between the electrodes, the resistance between the electrodes changing in proportion to the degree of angular displacement between the initial position and the displaced position;

current responsive means coupled to the electrodes for producing an electrical signal related to the resistance between the two electrodes within the conduit; and signal responsive means coupled to the current responsive means which produces an indication of the degree to which the head is angularly displaced from the initial position.

2. The device of claim 1, further comprising:

a signal adjuster coupled to the current responsive means for adjusting the electrical signal so that the indication is not provided when in the initial position.

3. The device of claim 1, further comprising:

a signal interrupter coupled to the current responsive means for adjusting the electrical signal so that the indication is not provided when the object is angularly displaced to a preselected displaced position.

4. The device of claim 1, wherein:

the indication is audible.

5. The device of claim 1, wherein:

the conduit is formed from a fluid impermeable, arcuate tubular member.

6. The device of claim 1, wherein:

the conduit is formed from a substantially circular, fluid impermeable tubular member.

7. A device adapted to be carried on a person's head for monitoring the position of the person's head, comprising in combination:

a sensor which includes:

a hollow, fluid impermeable conduit which contains a conductive liquid, a portion of the conduit having a cross-sectional area which is less than the remainder of the conduit, the conduit being shaped so that the liquid flows through said portion as the conduit is angularly displaced between an initial position and a displaced position;

a fluid reservoir which is in fluid communication with said portion, the fluid reservoir containing an amount of the conductive liquid, the conductive liquid within the fluid reservoir moving from a first level to a second level in response to angular displacement between the initial and displaced positions; and a pair of electrodes which are spaced apart and in contact with the conductive liquid so that electrical current passes between the electrodes, the current between the electrodes changing as the conductive liquid within the reservoir moves between the first and second levels;

current responsive means coupled to the electrodes which produces an electrical signal in response to the change in current flow between the electrodes; and sensor responsive means coupled to the electrodes for providing an indication if the electrical signal is produced.

8. The device of claim 7, wherein:

the indication is audible.

9. The device of claim 7, wherein:

the conduit is an arcuate tubular member and said portion is a fluid constriction located within the tubular member which divides the tubular member into opposite arms; and the fluid reservoir is formed from a length of fluid impermeable tubing which is in fluid communication with the fluid constriction.

10. The device of claim 7, wherein:

the conduit is formed from a substantially circular, fluid impermeable tubular member having an upper half and a lower half with said portion being located in the lower half of the tubular member; and the fluid reservoir is formed from a fluid impermeable, length of tubing which extends between the upper and lower halves of the tubular member and which is in fluid communication therewith.

11. The device of claim 9, wherein:

each arm of the conduit on either side of the fluid constriction has a cross-sectional area which is different in size from that of the other.

12. The device of claim 7, wherein:

the fluid reservoir has a cross-sectional area that is less than said remainder of the conduit.

13. The device of claim 9, wherein:

each arm of the conduit on either side of the fluid constriction has a cross-sectional area which is different in size from that of the other; and the fluid reservoir has a cross-sectional area that is less than that arm of the conduit having the greater cross-sectional area.

14. A device adapted to be carried on a person's head for monitoring the position of the person's head, comprising in combination:

a sensor which includes:

a hollow, fluid impermeable conduit which contains a conductive liquid, a portion of the conduit having a cross-sectional area which is less than the remainder of the conduit, the conduit being shaped so that the liquid flows through said portion as the head is angularly displaced between an initial position and a displaced position;

a fluid reservoir which is in fluid communication with said portion, the fluid reservoir containing an amount of the conductive liquid, the conductive liquid within the fluid reservoir moving from a first level to a second level when the flow rate of the liquid flowing through said portion reaches a selected value;

a first pair of electrodes which extend into the conduit and are spaced apart, the liquid contacting the electrodes as the liquid flows within the conduit so that a first electrical current passes between the electrodes;

a second pair of electrodes which are spaced apart and in contact with the conductive liquid so that a second electrical current flows between the second pair of electrodes, and wherein the current flowing between the second pair of electrodes changes as the conductive liquid within the reservoir moves between the first and second levels;

current responsive means coupled to the electrodes for producing a first electrical signal in response to current flowing between the first pair of electrodes, and a second electrical signal in response to changes in current flow between the second pair of electrodes; and signal responsive means coupled to the current responsive means which selectively produces a first indication in response to the first electrical signal, and which produces a second indication in response to the second electrical signal.

15. The device of claim 14, wherein:

the resistance between the first pair of electrodes changes in proportion to the degree of angular displacement between the initial and displaced positions;

the first electrical signal changes with changes in the resistance between the first pair of electrodes; and the first indication varies with changes in the first electrical signal.

16. The device of claim 14, further comprising:

a signal interrupter coupled to the current responsive means for adjusting the first electrical signal so that the first indication is not provided by the signal responsive means when the sensor senses a preselected displaced position.

17. The device of claim 14, wherein:

the conduit is formed from a substantially circular, fluid impermeable tubular member having an upper half and a lower half with said portion being located in the lower half of the tubular member; and the fluid reservoir is formed from a fluid impermeable length of tubing which extends between the upper and lower halves of the tubular member and which is in fluid communication therewith.

18. The device of claim 14, wherein:

the conduit is an arcuate tubular member and said portion is a fluid constriction located within the tubular member which divides the tubular member into opposite arms; and each arm of the conduit has a cross-sectional area which is different in size from that of the other.

19. The device of claim 14, wherein:

the fluid reservoir has a cross-sectional area that is less than said remainder of the conduit.

20. The device of claim 18, wherein:

the fluid reservoir has a cross-sectional area that is less than that arm of the conduit having the greater cross-sectional area.

* * * * *